US012460279B2

(12) United States Patent
Cai

(10) Patent No.: US 12,460,279 B2
(45) Date of Patent: Nov. 4, 2025

(54) COSMETIC ZINC ALLOY MASSAGE HEAD FORMULA AND PREPARATION TECHNOLOGY THEREOF

(71) Applicant: Guangzhou Candear Packing Products Co., LTD, Guangzhou (CN)

(72) Inventor: Guoxiang Cai, Guangzhou (CN)

( * ) Notice: Subject to any disclaimer, the term of this patent is extended or adjusted under 35 U.S.C. 154(b) by 0 days.

(21) Appl. No.: 18/681,000

(22) Filed: May 31, 2024

(65) Prior Publication Data

US 2025/0230525 A1 Jul. 17, 2025

(30) Foreign Application Priority Data

Jan. 17, 2024 (CN) ..... 202410065504.5

(51) Int. Cl.

| | |
|---|---|
| ***C22C 18/04*** | (2006.01) |
| ***B22D 21/02*** | (2006.01) |
| ***C25D 3/12*** | (2006.01) |
| ***C25D 3/38*** | (2006.01) |
| ***C25D 5/12*** | (2006.01) |

(52) U.S. Cl.

CPC ..... *C22C 18/04* (2013.01); *B22D 21/027* (2013.01); *C25D 3/12* (2013.01); *C25D 3/38* (2013.01); *C25D 5/12* (2013.01)

(58) Field of Classification Search

CPC ..... C22C 18/04; C22F 1/165

See application file for complete search history.

(56) References Cited

U.S. PATENT DOCUMENTS

2015/0349315 A1* 12/2015 Shope ..... C22C 18/04 29/875

* cited by examiner

*Primary Examiner* — Jessee R Roe

(74) *Attorney, Agent, or Firm* — Sandy Lipkin

(57) ABSTRACT

The invention discloses a cosmetic zinc alloy massage head formula and a preparation technology thereof. The formula comprises the following raw materials: 4.19% of aluminum, 0.0027% of lead, 0.0005% of cadmium, 0.0011% of copper, 0.0073% of iron, 0.044% of magnesium, smaller than 0.0005% of tin, smaller than 0.001% of nitrogen, and zinc for the residual. A zinc alloy massage head has high impact strength and good tear resistance, and the technology can effectively improve conductivity stability and fullness, the surface strength and abrasive resistance of products; the conductivity of the alloy head is good after water electroplating; the conductivity of the alloy head is greatly improved, which is conducive to releasing charged ions on the surface of the human body, and especially in winter, the alloy head can release static electricity generated by dry air, and play a similar role as a ground wire in a current circuit.

1 Claim, No Drawings

COSMETIC ZINC ALLOY MASSAGE HEAD FORMULA AND PREPARATION TECHNOLOGY THEREOF

REFERENCE TO PRIOR APPLICATION

This application claims priority to Chinese Patent Application 202410065504.5, filed on Jan. 17, 2024, which is incorporated herein by reference.

TECHNICAL FIELD

The present invention relates to the technical field of cosmetic massage heads, in particular to a cosmetic zinc alloy massage head formula and a preparation technology thereof.

BACKGROUND

Cosmetics: preparations (other than soap) used on the human body for the purpose of beautifying, preserving or changing the appearances of persons (e.g. for performances), or used for cleansing, dyeing, scrubbing, correcting or protecting skin, hair, nails, eyes or teeth. Cosmetics are widely used by individuals for modifying or improving the appearances of persons, for example in response to fashion trends or for display of individuality. Then, the existing cosmetics are not simply applied. Sometimes the effectiveness of the cosmetics is further ensured through instruments. Therefore, massage heads emerge as the times require and mostly made of hard materials.

The prior art has the following defects or problems:

The existing cosmetic massage heads are low in impact strength and prone to tearing and deformation when being used for a long time; during the preparation process of the existing cosmetic massage heads, various problems are likely to occur as the temperature changes, such as serious deformation and explosion during high-temperature sintering, and the temperature conductivity of the product and the die-casting fullness of the product cannot be guaranteed; the product surface hardness and the abrasive resistance are relatively low; in addition, the existing massage heads do not have electrical conductivity, and cannot release charged ions on the surface of the human body and static electricity generated by dry air in winter.

SUMMARY

The present invention aims at providing a cosmetic zinc alloy massage head formula and a preparation technology thereof in view of the deficiencies of the prior art, so as to solve the problems raised in the background art.

In order to achieve the aforementioned purpose, the present invention provides the following technical solution: a cosmetic zinc alloy massage head formula comprises the following raw materials in parts by weight: 4.19% of aluminum, 0.0027% of lead, 0.0005% of cadmium, 0.0011% of copper, 0.0073% of iron, 0.044% of magnesium, smaller than 0.0005% of tin, smaller than 0.001% of nitrogen, and zinc for the residual.

Another technical problem to be solved by the present invention is to provide a preparation technology of a cosmetic zinc alloy massage head formula, which comprises the following steps:

step one: select various materials according to the parts by weight, and storing the materials in a sealed manner to avoid surface oxidation;

step two: placing a zinc ingot into a high-temperature treatment container to melt the zinc ingot into liquid molten alloy, and then pour the liquid molten alloy into a metal mold through external mechanical equipment to complete the shaping;

step three: opening the mold, and taking out a product, a runner and a cinder ladle;

step four: splitting the product and a water outlet through ultrasonic equipment, to separate the product and the water outlet;

step five: grinding off burrs on the surface of the product with an emery wheel, and polishing the surface, part of which cannot be roughly polished through canvas;

step six: performing fine polishing with small stone rice after vibration polishing is performed through large stone rices;

step seven: cleaning the surface with pure water, dry it, and putting the product into ultrasonic cleaning equipment to clean stains;

step eight: hanging the product on the rack, immersing the product in a water electroplating tank, ensuring that alkali copper ions in the tank are attached to the surface of alloy with electric ions, and replacing the tank; then ensuring that pyrophosphate copper ions in the tank are attached to the surface of alkali copper with electric ions, and replacing the tank;

step nine: ensuring that nickel ions in the tank are attached to the surface of acid copper with electric ions, and replacing the tank; ensuring that white copper tin ions in the tank are attached to the surface of nickel with electric ions, and replacing the tank; ensuring that white copper ions in the tank are attached to the surface of white copper tin with electric ions, and taking the product out from the tank;

step ten: disassembling the product from the rack after drying, and completing the inspection with circuits after selection.

Further, the interior of the high-temperature treatment container needs to be controlled at 470 degrees Celsius.

Further, the stone rices are selected according to the shapes of workpieces and the relevant sizes of all components; the sizes are selected between 1 and 10 mm; the vibration time of the large stone rices is 480 minutes, and the vibration time of the small stone rices is 180 minutes.

Further, the cleaning time is controlled to 15 minutes, and the drying time is controlled to 20 minutes.

Further, the treatment time is controlled to 5 minutes.

Further, the acid copper ion attachment process lasts for 30 minutes; the nickel ion attachment process lasts for 12 minutes; the white copper tin ion attachment process lasts for 2 minutes.

Further, the drying time lasts for 30 minutes, and for circuit detection, specifically, whether the power is on is detected.

Compared with the prior art, the present invention provides a cosmetic zinc alloy massage head formula and a preparation technology thereof, which has the following beneficial effects:

The cosmetic zinc alloy massage head formula and the preparation technology thereof have the advantages that a zinc alloy massage head made of aluminum, lead, cadmium, copper, iron, magnesium, tin, nitrogen and zinc has high impact strength and good tear resistance, and the preparation technology can effectively improve the conductivity stability and fullness of products, and improve the product surface strength and abrasive resistance, to prolong the service life of the cosmetic zinc alloy massage head; in addition, zinc alloy has conductivity, and the conductivity of the zinc alloy head is good after water electroplating layer by layer; after water electroplating layer by layer, the conductivity of the zinc alloy head is greatly improved, which is conducive to releasing charged ions on the surface of the human body, and especially in winter, the zinc alloy head can release static electricity generated by dry air, and play a similar role as a ground wire in a current circuit.

DETAILED DESCRIPTION OF EMBODIMENTS

The technical solutions in the embodiments of the present invention will be clearly and completely described below in conjunction with the embodiments of the present invention, and it is clear that the embodiments described are a part of the embodiments of the present invention, and not all of them. Based on the embodiments of the present invention, all other embodiments obtained by a person skilled in the art without inventive work shall fall within the scope of protection of the present invention.

In this embodiment: a cosmetic zinc alloy massage head formula comprises the following raw materials in parts by weight: 4.19% of aluminum, 0.0027% of lead, 0.0005% of cadmium, 0.0011% of copper, 0.0073% of iron, 0.044% of magnesium, smaller than 0.0005% of tin, smaller than 0.001% of nitrogen, and zinc for the residual.

Based on cosmetic zinc alloy massage head formula, a preparation technology of the cosmetic zinc alloy massage head formula is proposed, which comprises the following steps:

step one: select various materials according to the parts by weight, and storing the materials in a sealed manner to avoid surface oxidation;

step two: placing a zinc ingot into a high-temperature treatment container to melt the zinc ingot into liquid molten alloy, and then pour the liquid molten alloy into a metal mold through external mechanical equipment to complete the shaping;

step three: opening the mold, and taking out a product, a runner and a cinder ladle;

step four: splitting the product and a water outlet through ultrasonic equipment, to separate the product and the water outlet;

step five: grinding off burrs on the surface of the product with an emery wheel, and polishing the surface, part of which cannot be roughly polished through canvas;

step six: performing fine polishing with small stone rice after vibration polishing is performed through large stone rices;

step seven: cleaning the surface with pure water, dry it, and putting the product into ultrasonic cleaning equipment to clean stains;

step eight: hanging the product on the rack, immersing the product in a water electroplating tank, ensuring that alkali copper ions in the tank are attached to the surface of alloy with electric ions, and replacing the tank; then ensuring that pyrophosphate copper ions in the tank are attached to the surface of alkali copper with electric ions, and replacing the tank;

step nine: ensuring that nickel ions in the tank are attached to the surface of acid copper with electric ions, and replacing the tank; ensuring that white copper tin ions in the tank are attached to the surface of nickel with electric ions, and replacing the tank; ensuring that white copper ions in the tank are attached to the surface of white copper tin with electric ions, and taking the product out from the tank;

step ten: disassembling the product from the rack after drying, and completing the inspection with circuits after selection.

It should be noted that the interior of the high-temperature treatment container needs to be controlled at 470 degrees Celsius; the stone rices are selected according to the shapes of workpieces and the relevant sizes of all components; the sizes are selected between 1 and 10 mm; the vibration time of the large stone rices is 480 minutes, and the vibration time of the small stone rices is 180 minutes; the cleaning time is controlled to 15 minutes, and the drying time is controlled to 20 minute; the treatment time is controlled to 5 minutes; the acid copper ion attachment process lasts for 30 minutes; the nickel ion attachment process lasts for 12 minutes; the white copper tin ion attachment process lasts for 2 minutes; the drying time lasts for 30 minutes, and for circuit detection, specifically, whether the power is on is detected.

Finally, it should be noted that the foregoing is only a preferable embodiment of the present invention, and is not intended to limit the present invention. Although the present invention is described in details with reference to the foregoing embodiments, it is still possible for a person skilled in the art to modify the technical solutions described in the foregoing embodiments or to make equivalent substitutions for some of the technical features therein. Any modification, equivalent replacement and improvement made within the spirit and principle of the present invention shall be included within the protection scope of the present invention.

What is claimed is:

1. A cosmetic zinc alloy massage head formula, characterized by comprising the following raw materials in parts by weight: 4.19% of aluminum, 0.0027% of lead, 0.0005% of cadmium, 0.0011% of copper, 0.0073% of iron, 0.044% of magnesium, smaller than 0.0005% of tin, smaller than 0.001% of nitrogen, and zinc for the residual.

* * * * *